US006006862A

United States Patent [19]

Palmer

[11] Patent Number: 6,006,862

[45] Date of Patent: Dec. 28, 1999

[54] TEMPORARY GUARD RAIL ASSEMBLY FOR SCAFFOLDING

[76] Inventor: John Palmer, 1915 Lauren Lake Dr., League City, Tex. 77573

[21] Appl. No.: 08/826,781

[22] Filed: Apr. 7, 1997

[51] Int. Cl.[6] ..... E04G 5/00

[52] U.S. Cl. ..... 182/113

[58] Field of Search ..... 182/113, 121, 182/122, 117, 179.1

[56] References Cited

U.S. PATENT DOCUMENTS

| | | | |
|---|---|---|---|
| D. 331,529 | 12/1992 | Reinklou | D8/73 |
| 592,050 | 10/1897 | Freeland . | |
| 2,578,119 | 12/1951 | Yench | 182/113 |
| 2,662,716 | 12/1953 | Cowrey | 182/117 |
| 3,752,262 | 8/1973 | Helms | 182/113 |
| 3,867,997 | 2/1975 | Hyslop | 182/113 |
| 4,782,914 | 11/1988 | Nail | 182/113 |
| 5,070,965 | 12/1991 | Jordan | 182/113 |
| 5,125,477 | 6/1992 | Jordan | 182/113 |
| 5,145,030 | 9/1992 | Pavlescak et al. | 182/113 |
| 5,154,256 | 10/1992 | Wood | 182/113 |
| 5,386,961 | 2/1995 | Lu . | |

FOREIGN PATENT DOCUMENTS

| | | | |
|---|---|---|---|
| 126354 | 12/1947 | Australia | 403/385 |
| 509108 | 1/1955 | Italy | 403/385 |

*Primary Examiner*—Alvin Chin-Shue
*Attorney, Agent, or Firm*—Russell J. Egan

[57] ABSTRACT

A temporary guard rail assembly for scaffolding has a first clamping assembly engaging the horizontal member of scaffolding, a second clamping member engaging an adjacent vertical member of the scaffolding, an adjustable arm assembly connecting the first and second clamping assemblies, and a guard rail support extending vertically from the first clamping assembly. The first and second clamping assemblies are fastened to the respective members of the scaffolding to provide, vertically extending guard rail supports above the uppermost members of the scaffolding. Guard rails are positioned on the supports and provide fall protection for workers prior to their moving to the top most level of the scaffolding

8 Claims, 4 Drawing Sheets

TEMPORARY GUARD RAIL ASSEMBLY FOR SCAFFOLDING

BACKGROUND OF THE INVENTION

1. The Field of the Invention

The present invention relates to the art of scaffolding and, in particular, to means providing a fall safety rail on the top most level of scaffolding prior to complete assembly of and after complete disassembly of that level.

2. The Prior Art

In typical scaffold constructions, two spaced apart upright members are secured in proper upright position on base members and held in place by side cross braces. Guard rails are attached between the uprights on the outward side of the scaffolding, the side away from a building. Floor boards are extended between the uprights so that workmen can stand on and work on the stable, elevated temporary flooring. However, it has been found that workers can, for one reason or another, fall through unprotected spaces between the floor, cross braces, and uprights. For this reason OSHA, a federal regulatory and safety agency has imposed many regulations on the industry to require suitable fall protection on the scaffolding. While it is fairly easy to hang guard rails on erected portions of scaffolding, it is practically impossible to provide guard rails on the next uppermost level to be erected with the structures and equipment currently available in the industry.

A typical state of the art scaffolding assembly is shown in U.S. Pat. No. 4,782,914. Construction scaffolding of this type is standardized in the industry and comprises pairs of laterally spaced apart inverted U-shaped uprights each having a work facing rear side and an outwardly facing front side. The uprights are secured in an upstanding position by cross brace assemblies interconnecting the pairs of uprights on both the front and rear sides. Floor boards, which are either wooden or metal planks, are secured between the uprights to provide a temporary walking and standing platform.

Building scaffolding has long been considered to be a hazardous occupation and many safety devices have been proposed to assure that workmen will not fall from the scaffolding. There is, however, an inherent problem in building scaffolding in how to provide fall prevention means at the top of scaffolding before the workmen get up on that level to complete the assembly thereof The most often proposed solution to this problem is to provide safety harnesses for the workmen. But this raises the problem of what to attach the safety harness to. Generally such harnesses are attached to something above the workmen so as to limit the distance they may fall. However, if there is no structure adjacent to the scaffolding, then this is not a viable solution. This leaves only the possibility of tieing to the scaffolding. This, however, is not a good solution since a falling workman would build up significant velocity in falling, prior to being restrained, and this would cause problems in arresting the fall. Further, a workman would not be likely to fall straight down off the edge of the scaffolding but fall outward away from the scaffolding. This would create components of force perpendicular to the vertical surface of the scaffolding, tending to pull the scaffolding down, as well as causing the workman to swing into the scaffolding at the end of this fall, possibly causing further injury by contact with the scaffolding.

U.S. Pat. No. 3,867,997 discloses a guard rail support assembly which is attached beneath a scaffolding platform.

One end of the assembly extends beyond the lateral edge of the platform and has an upright post pivotally attached thereto. When the assembly is positions on the platform, the upright post is rotated to an upright position, locked in place, and guard rail suspended therefrom.

The present invention proposes a solution to this problem by providing a temporary guard rail assembly which can be erected from below to provide a guard rail already in place before a workman rises to the uppermost level to complete the scaffolding.

The present invention relates to temporary guard rails used, for example, in scaffolding in the construction industry, and more particularly to a temporary guard rail assembly which can be elevated to and secured above the upper most level of scaffolding prior to assembly of the scaffolding at that level. In a similar fashion, the subject temporary guard rail assembly would be the last portions of scaffolding removed as the scaffolding is disassembled, and the removal of this temporary guard rail would be accomplished from the next successive lower level.

SUMMARY OF THE INVENTION

A temporary guard rail assembly for scaffolding has a first clamping assembly for engaging the horizontal member of scaffolding, a second clamping member for engaging an adjacent vertical member of the scaffolding, an adjustable arm assembly connecting the first and second clamping assemblies, and guard rail supports extending from the first clamping assembly. The first and second clamping assemblies are fastened to the respective members of the scaffolding to provide guard rail receiving uprights extending vertically above the uppermost members of the scaffolding. Guard rails are suspended on the uprights and provide fall protection for workers immediately upon their moving to the top most level of the scaffolding.

BRIEF DESCRIPTION OF THE DRAWINGS

The present invention will now be described, by way of example, with reference to the accompanying drawings in which.

DETAILED DESCRIPTION OF AN EMBODIMENT OF THE INVENTION

Figure 1:
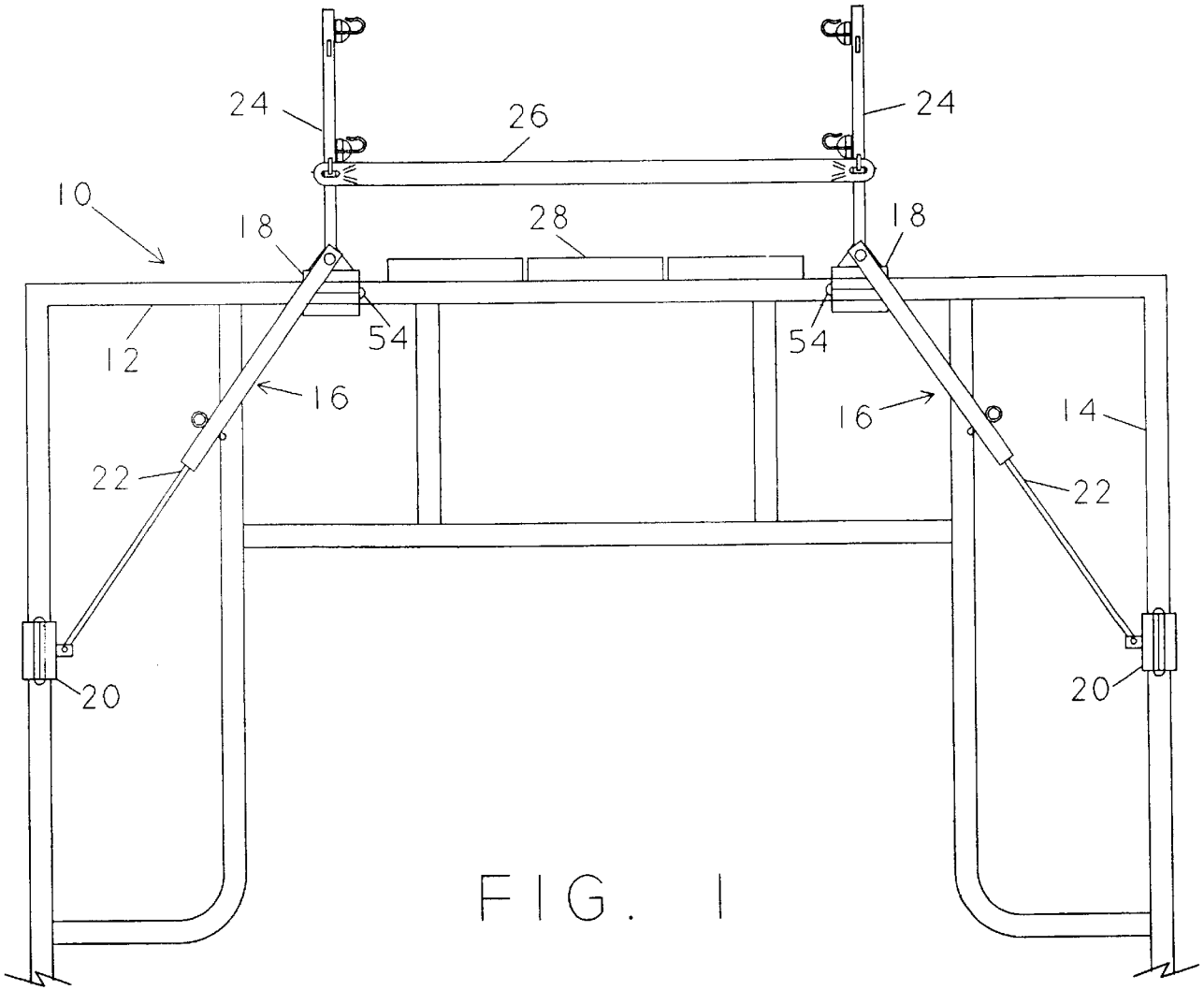
FIG. 1 is an end elevation of a scaffolding upright, looking out from the inner side, with two of the subject temporary guard rail supports mounted thereon.

FIG. 1 is an elevation from the inner side of a typical inverted U-shaped upright 10 forming an end of a module of scaffolding. The feet of this upright have not been shown since any scaffolding starts at ground level and is built up from there by placing the uprights one upon another and only the upper ends of the uprights are of concern to the present invention. However, the present invention is intended for use at all levels of the scaffolding during its erection and disassembly. The horizontal support bar 12 of the upright is above the head of the average workman, about 6'6" from the temporary floor. The vertical supports 14 are parallel spaced about 7' apart. It would be difficult, if not impossible, for the normal workman to place any known type of fall restraint above the upright without first climbing to the top of the upright. This would then place the worker in the dangerous position of being at the top of the scaffolding without any fall protection while there to install fall protection.

Figure 2:
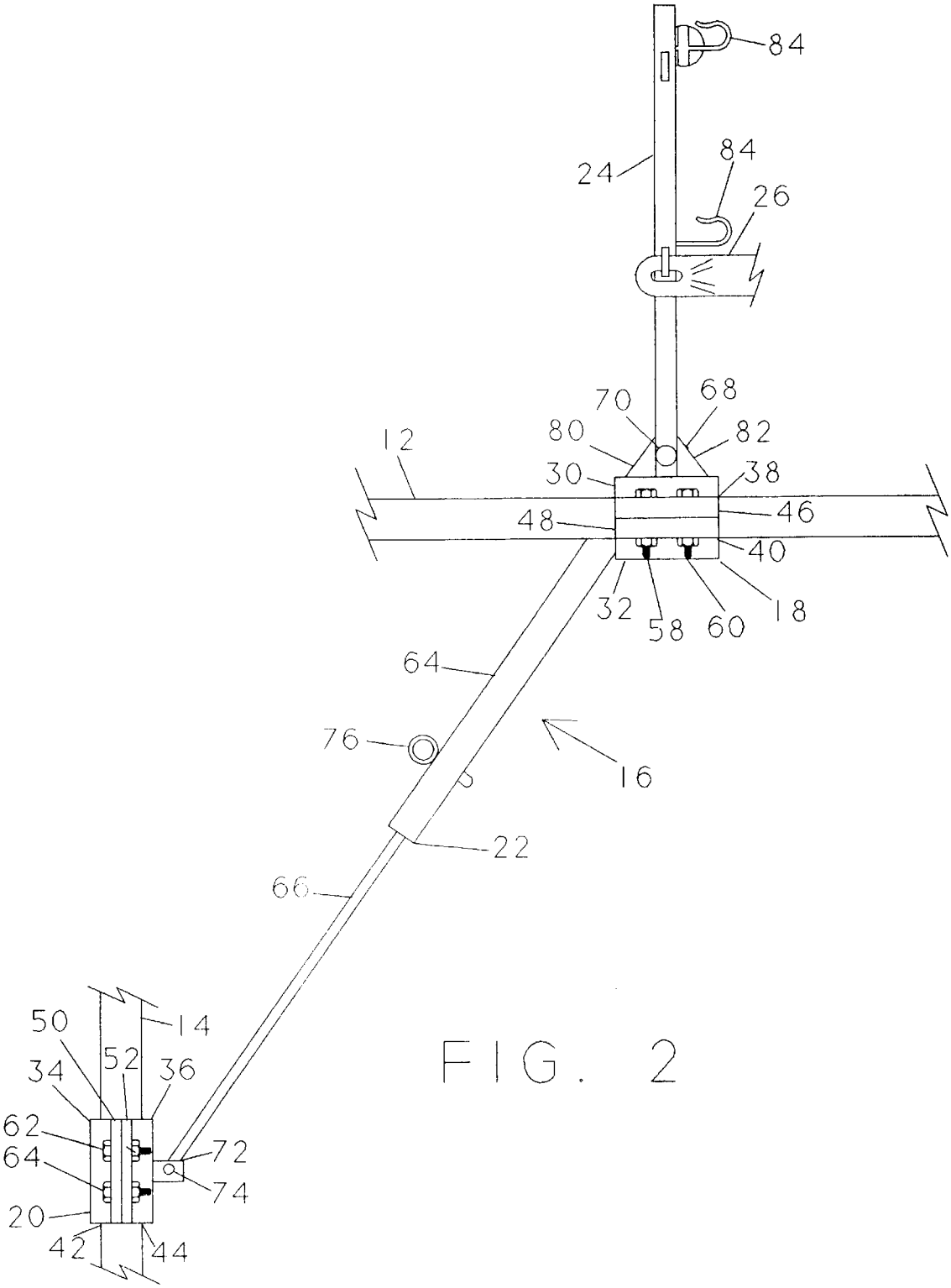
FIG. 2 is a side elevation of the temporary guard rail assembly of the present invention taken from the opposite side from FIG. 1.
Figure 3:
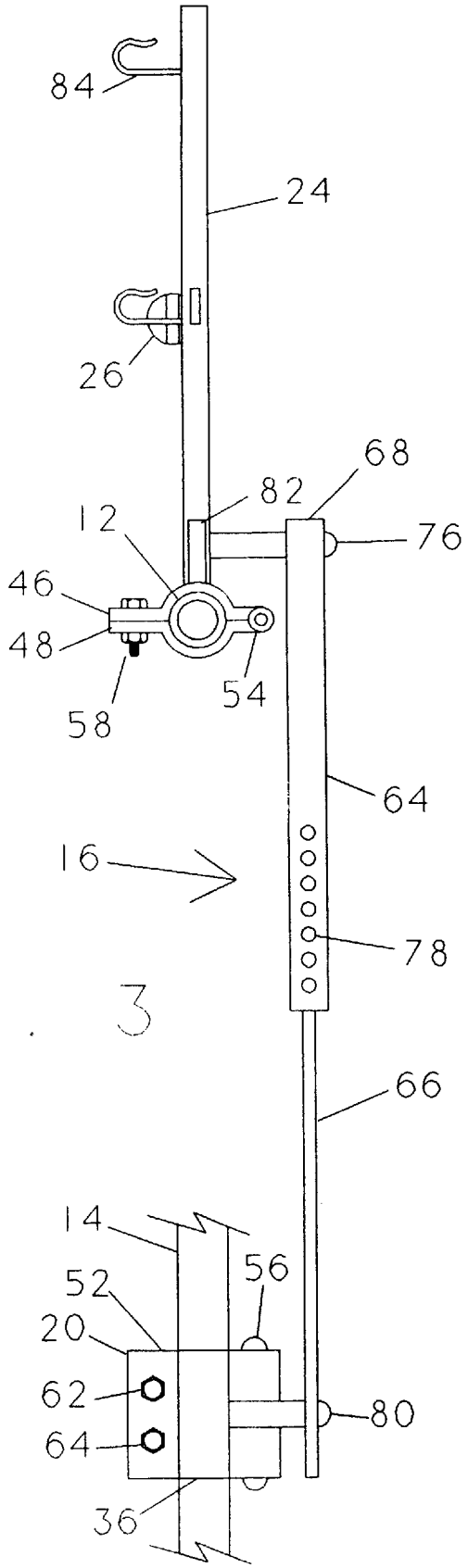
FIG. 3 is another side elevation of the present invention taken 90° to the right from that of FIG. 2.
Figure 5:
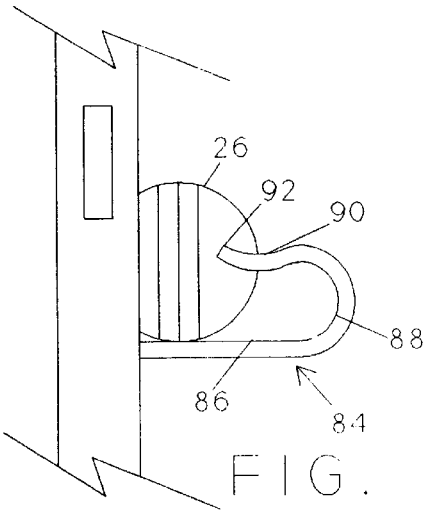
FIG. 5 is an end elevation of a guard rail attachment means with a guard rail positioned for attachment.
Figure 4:
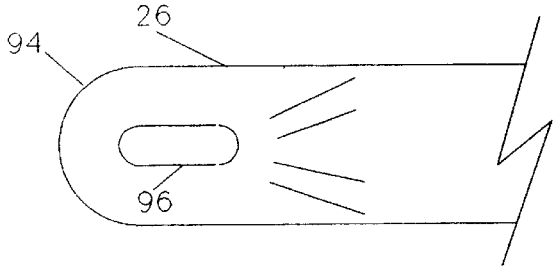
FIG. 4 is a detail view of one end of a typical guard rail.

FIGS. 1 to 3 illustrate an embodiment of the present invention, which overcomes the problem of providing fall protection at the upper most level of scaffolding. FIG. 1 shows the subject invention installed on an upright 10 while FIGS. 2 and 3 show side and end elevations to reveal the details of an embodiment of the present invention. The upright 10 of FIG. 1 is at the end of a module and fitted with two of the subject temporary guard rail supports 16. Each had a first clamping means 18, and second clamping means 20, and adjustable arm 22, and a guard rail supporting upright 24. A guard rail 26 is shown spanning the end of the walk platform formed by planks 28.

The installation shown in FIG. 1 is fairly typical and should not be considered in any manner as a restriction of the present invention. The installation shown has three planks place on top of the upright, one or more planks being used at the option of the scaffolding crew. In each case, the temporary guard rails 16 are adjusted, using the adjustable arms 22, to provide the desired spacing therebetween to accommodate desired number of planks and the guard rail 26. These guard rails can be either in standard lengths (2', 4', 6, etc.) or can be telescoping guard rails (not shown).

Turning now to FIGS. 2 and 3, side and end elevations, respectively, of the present invention are shown in detail with only segments of a horizontal member 12 and a vertical member 14 of a typical upright. The first and second clamping assemblies 18, 20 are essentially sleeve members received on the respective horizontal and vertical members of the upright. They have been shown as pairs of mirror image clamping members 30, 32, 34, 36, each having profiled scaffolding engaging portions 38, 40, 42, 44 and outwardly extending flanges 46, 48, 50, 52 on a first side and hinge connections 54, 56 on the opposite side (see FIG. 3). The clamping members have been shown secured together, gripping there between the respective portions of the scaffolding members, by bolts 58, 60, 62, 64 passing through the respective flanges of the pairs of clamping members. While conventional nuts and bolts have been shown, it should be understood that any known fastening means, such as wing nuts, could also be used without departing from the teaching of the present invention.

The adjustable arm 22 has been shown as a telescoping arm formed by first arm member 64 receiving therein second arm member 66. The free end 68 of first arm member 64 is attached to first clamping assembly 18 by first pivot means 70 and the free end 72 of the second arm member 66 is joined to the second clamping assembly 20 by a similar second pivot means 74. The relative overall length of the two telescoping arms is controlled by one or more pin 76 received in aligned holes 78.

The guard rail support upright 24 is secured to and extends normal to the axis of the first clamping means 18 and is provided with bracing gussets 80, 82. They are further provided with at least one guard rail mounting means 84 whereby a guard rail 26 can be secured on the upright. The guard rail mounting means 84 can best be seen and understood from FIGS. 4 to 7. Each mounting means 84, which can be made from round or flat section stock, has a flat portion 86, an upwardly and inwardly directed hook portion 88, a reverse curved valley portion 90, and a profiled tip portion 92. The ends 94 of conventional guard rails 26, which typically are formed from 1" diameter round pipe, are flattened and provided with a slot 96.

Figure 6:
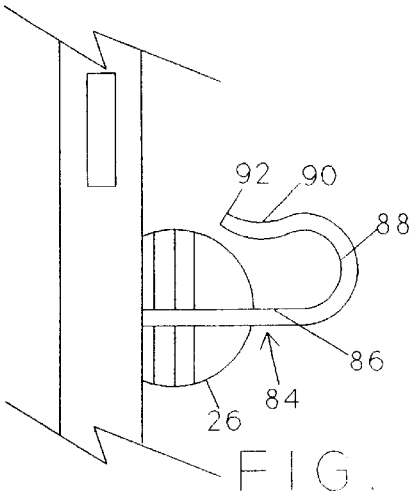
FIG. 6 is a similar elevation showing the guard rail after rotation into an attached condition.
Figure 7:
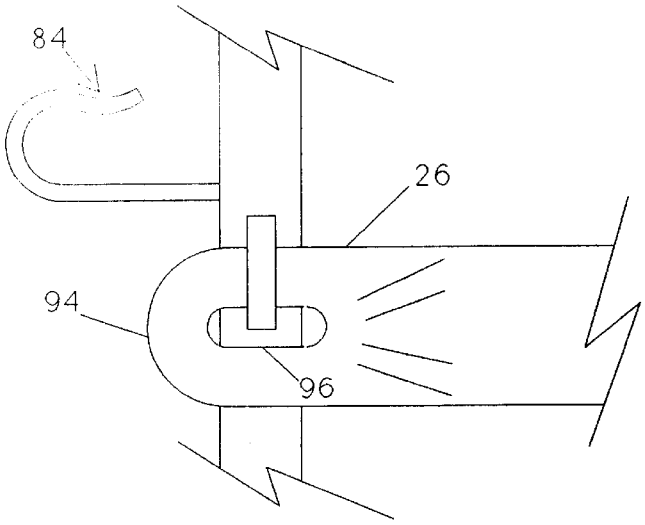
FIG. 7 is a side elevation of the attached guard rail.

As will be understood from FIGS, 4 to 7, each end 94 of the guard rail 26 is laid into the mounting means 84 with the flattened end generally vertical and the slot 96 generally aligned with the profiled tip 92. It is during this positioning of the guard rail that the valley portion 90 comes into play. It can be readily appreciated that the guard rail 26 will have to be raised into position from below using an extension pole (not shown) which can have a wide variety of configurations. It would be very difficult, even using poles at both ends of the guard rail, to simultaneously get both ends of the guard rail properly positioned. The valley portion 90 serves as a rest and allows one end of the guard rail to be nearly correctly positioned and supported while the second end of the guard rail is similarly raised and positioned. When both ends of the guard rail 26 have been properly positioned, the guard rail 26 is rolled about its longitudinal axis to engage the slots 96 with the profiled tips 92 with the guard rail 26 ending up hanging from the flat portions 86 of the mounting means 84, as shown in FIGS. 6 and 7. It will be appreciated that this positions the guard rail so that it cannot be displaced either outwardly (because of the upright 24) or downwardly (because of the mounting means 84). It should be noted that each upright 24 will be provided with guide rail mounting means at least at two heights and extending in two directions, at right angles to each other, to allow for placement of guard rails both on the side and end of any scaffold module, as shown in FIG. 1. Preferably the two sets of mounting means are vertically offset to prevent interference of the guard rails.

As scaffolding is erected, upon completion of one level and prior to assembling the next successive top level, the subject temporary guard rail assembly 16 would be applied to both sides of each upright 10 at each end of each module of the scaffolding, see FIG. 1. Each assembly would be attached to the horizontal and vertical members 12, 14 of the upright 10 with the guard rail upright 24 becoming the uppermost members of the scaffolding. The assemblies would be spaced apart a distance sufficient to allow placement of the desired number of planks therebetween. This placement is accommodated by the adjustable arms 22. The guard rails 26 would then be raised to and engaged with the guard rail mounting means 84 on each upright 24, as explained above, to thereby provide fall prevention before the first worker climbs to the top most level of the scaffolding to begin assembly thereof As each level of the scaffolding is completed, a new set of temporary guard rail assemblies would be applied until the scaffolding reaches the desired height.

In a somewhat similar fashion, as the scaffolding is disassembled, when one level of the scaffolding is cleared of all the other the scaffolding structure, uprights, cross braces, planks, etc., the temporary guard rails would remain in place to protect the workers from falls. When the level is completely cleared, the workers would descend to the next lower level and remove the guard rails 26 and the subject temporary guard rail supports 16 as the last step in disassembling the upper most level and prior to beginning to disassembly of the level upon which the workers are now standing. During this disassembly the valley portions 90 again come into play. The guard rails 26 must be rotated about their longitudinal axes to remove them from the mounting means 84. It will be appreciated that there can be expected to be a great deal of difficulty in remotely accomplishing this maneuver simultaneously at both ends of the guard rail. The present invention allows the worker to detach one end or the guard rail and place it in the valley portion 90 where it will remain while the second end of the guard rail is removed from the other guard rail support.

While hingedly attached clamping assembly members have been shown in this operational other guard rail support.

While hingedly attached clamping assembly members have been shown in this operational embodiment, it is within the purview of the present invention to make the clamping assemblies in other fashions. For example, both sides of the clamping member could be flanged so that the mating members could be placed around the respective member of the upright and then secured by bolts passing through mating flanges the clamping members. The bolts illustrated could be replaced by other known connect devices. The mating sleeve members could also be provided with interlocking means which allow them to be assembled on the upright and then secured in place by a bolt or screw passing through the members and engaging the upright members.

The present invention has been shown in this embodiment for illustrative purposes only. The present invention may be subject to many modifications and changes without departing from the spirit or essential characteristics thereof Therefore the scope of the present invention should be determined in all respects by the appended claims rather than the foregoing description.

I claim:

1. A guard rail assembly for attachment to respective upper most horizontal and vertical portions of a scaffolding during assembly and disassembly thereof, to provide temporary fall protection for workers on the upper most level of said scaffolding, said guard rail assembly comprising:

a first clamping member for engaging a horizontal first portion of said scaffolding;

a second clamping member for engaging an adjacent vertical second portion of the scaffolding;

a length adjustable arm member pivotally connected at each end to a respective first and second clamping member; and upright guard rail support fixed to and extending from said first clamping assembly in cantilever fashion normal to the horizontal clamping axis of said first member and having at least one guard rail receiving means thereon; and at least one guard rail mounted on said rail receiving means.

2. The guard rail assembly for scaffolding according to claim 1 wherein said clamping members comprise:

pairs of members adapted to be received on opposite sides of a respective portions of said scaffolding; and means to secure the pairs of members together tightly engaging the respective portion of said scaffolding therebetween.

3. The guard rail assembly for scaffolding according to claim 1 wherein said clamping members comprise:

pairs of members adapted to be received on opposite sides of a respective portion of said scaffolding, each member having at least one lateral flange; and means received in said flanges to secure the members together tightly engaging the respective scaffolding therebetween.

4. The guard rail assembly according to claim 1 wherein each said upright guard rail support has thereon at least one guard rail receiving means formed as an upwardly opening hook which receives an end of the guard rail therein, whereby said guard rail is rolled about its longitudinal axis into hooking engagement to be suspended from said upright.

5. A method for providing temporary guard rails on the upper most level of scaffolding, during erection and disassembly of a scaffolding comprising:

providing a first clamping member for engaging a horizontal first member of a scaffolding;

providing a second clamping member for engaging an adjacent vertical second member of the scaffolding;

providing a length adjustable arm assembly pivotally connected at each end to a respective first and second clamping members; and providing an upright guard rail support fixed to aid extending vertically normal to the horizontal clamping axis of said first clamping assembly in cantilever fashion and having at least one guard rail receiving means thereon; and securing said first clamping member to an upper most horizontal firs member of said scaffolding with said second clamping member hanging down and said upright guard rail support projecting up above the upper most scaffolding member;

adjusting said arm connecting said first and second clamping members together such as to allow said second clamping member to engage said vertical second member of said scaffolding;

securing said second clamping member to said vertical second member of said scaffolding and raising guard rail members to engage the guard rail supports.

6. The method according to claim 5 wherein the first and second clamping members are each formed by a pair of mirror image halves having flanges for receiving there in means to secure the halves together tightly engaging the respective portion of the scaffolding therebetween.

7. The method according to claim 5 wherein each said upright guard rail support has thereon at least one guard rail receiving means formed as an upwardly opening hook which receives an end of the guard rail therein, whereby said guard rail is then rolled about its own axis into hooking engagement to be suspended from said upright.

8. In combination with a scaffolding, a guard rail assembly for attachment to said scaffolding in spaced pairs during assembly and disassembly of said scaffolding to provide temporary fail protection for workers on the upper most level of said scaffolding each said guard rail assembly comprising:

a first clamping member for engaging a first horizontal portion of said scaffolding, a second clamping member for engaging an adjacent second vertical portion of the scaffolding;

a length adjustable arm assembly pivotally connected at each end to a respective first and second clamping member; and upright guard rail support fixed to and extending vertically normal to the horizontal clamping axis of said first clamping member in cantilever fashion and having at least one means to receive guard rails thereon, whereby said guard rail assemblies are fitter in spaced relationship on the uppermost level of the scaffolding and guard rails mounted thereon to provide fall protection to workers on said upper most level of the scaffolding.

* * * * *

UNITED STATES PATENT AND TRADEMARK OFFICE

CERTIFICATE OF CORRECTION

PATENT NO. : 6,006,862

DATED : December 28, 1999

INVENTOR(S) : John Palmer

It is certified that error appears in the above-identified patent and that said Letters Patent is hereby corrected as shown below:

Column 5, delete lines 10-11

Claim 5 line 11, change "aid" to read --and--;

line 17, change "firs" to read --first--

Claim 6 line 3, change "there in"to read --therein--

Signed and Sealed this

Nineteenth Day of September, 2000

*Attest:*

Q. TODD DICKINSON

*Attesting Officer*

*Director of Patents and Trademarks*